US007114638B2

(12) United States Patent
Vaynshteyn et al.

(10) Patent No.: US 7,114,638 B2
(45) Date of Patent: Oct. 3, 2006

(54) BIN PARTITIONS TO IMPROVE MATERIAL FLOW

(75) Inventors: Mikhail Vaynshteyn, Rochester, NY (US); Paul M. Wegman, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 445 days.

(21) Appl. No.: 10/760,916

(22) Filed: Jan. 20, 2004

(65) Prior Publication Data

US 2005/0155989 A1 Jul. 21, 2005

(51) Int. Cl.
*B67D 5/06* (2006.01)

(52) U.S. Cl. ..... 222/181.1; 222/460; 220/528

(58) Field of Classification Search ..... 222/181.1, 222/460, 185.1, 563, 564, 461, 462; 220/528–530; 210/320, 304–306; 141/286, 297
See application file for complete search history.

(56) References Cited

U.S. PATENT DOCUMENTS 3,351,248 A * 11/1967 Baehr ..... 222/459
3,854,637 A * 12/1974 Muller et al. ..... 222/564
4,030,633 A * 6/1977 Fisher ..... 222/1
4,228,822 A * 10/1980 Fisher ..... 138/46
4,286,883 A 9/1981 Johanson
4,382,723 A * 5/1983 Moller ..... 406/90
4,548,342 A * 10/1985 Fisher ..... 222/145.8
4,721,231 A * 1/1988 Richter ..... 222/146.4
4,863,065 A * 9/1989 Decrane ..... 222/1
5,248,197 A * 9/1993 Storf et al. ..... 366/341
5,280,813 A * 1/1994 Jackson ..... 141/4
5,517,595 A 5/1996 Kleijn
5,769,281 A 6/1998 Bates
6,328,183 B1 12/2001 Coleman

* cited by examiner

*Primary Examiner*—Lien M. Ngo

(57) ABSTRACT

An insert in the form of a bin partition improves flow of powder or particulate material once installed into an existing bin. The insert has a triangular shape with a baffle on top of it covering a portion of the partition. The partition changes the shape of the exit area of a bin and enables better control of powder or particulate material flow, thus preventing bridging and uncontrolled flooding while filling the bin's hopper.

18 Claims, 2 Drawing Sheets

BIN PARTITIONS TO IMPROVE MATERIAL FLOW

BACKGROUND OF THE INVENTION

This disclosure relates in general to bulk material bins, and more particularly, to a mass flow bulk material bin.

Typically, a hopper bottom bin for flowable bulk materials, such as, dry powders or toner used in copiers/printers has a vertical cylindrical section joined at its lower edge to a conical or frusta-conical hopper. The bin is filled through an inlet opening at the top of the cylindrical section, and is emptied through an outlet at the lowermost point of the hopper. Discharge apparatus for guiding the material from the bin to its destination or starting and stopping the discharge flow is commonly bolted or welded to a bolt ring mounted around the outer surface of the hopper at its bottom.

While the heretofore-mentioned configurations are typical, the geometry of bins varies. For example, the inlet opening may be centered over the bin, or positioned to one side of the bin roof or on a sidewall of the bin. The hopper may be a right circular cone with a centered outlet, or a cone having an oblique axis and an outlet that does not lie along the central axis of the bin.

In nearly all bins, despite these variations, the segregation of material according to particle size, shape or density as it is introduced into a bin creates a problem. Material deposited in a bin generally forms a conical pile centered under the inlet opening, with coarse particles tending to roll outward down to the periphery of the bin and fine particles tending to accumulate in the center. This results in segregation of different size particles in different regions with the bin.

Yet another problem common to many bins is a tendency for segregation of material to become enhanced as the material is discharged from the bin. This is a result of funnel flow, where material directly above the discharge outlet moves downward at a greater speed than material elsewhere, while material in some regions of the bin may not move at all. If the outlet is located directly under the inlet, the fine particles that tend to accumulate directly under the inlet will be discharged before the coarser one, resulting in more pronounced segregation. If the outlet is elsewhere, the coarser particles will be discharged first, and more pronounced segregation will still result.

Another undesirable effect of funnel flow is that it causes layers of material deposited at successive time intervals to intermix in an uncontrolled manner. In some circumstances it is desirable to have material exit a bin in the same order that it entered, while in other situations, it may be desirable for material from successive layers to be blended together as the bin is emptied. Adequate control of the extent of the intermixing of layers, either to prevent or to promote their blending, is not provided by the structure of most bins.

In contrast to funnel flow, where some material in a bin moves downward while a portion remains stationary, mass flow is a condition where all material in the bin moves simultaneously, and not stand still. But, mass flow is difficult to obtain because the vast majority of bins are shaped like funnels, i.e., cylindrical vessels with a converging lower part that helps to contain and direct the discharge. The inherent exit flow problems of all symmetrically shaped bins filled with powder materials are bridging and "rat-holing". Bridging is when the powder forms internal spherical structure (arches), thus restricting of completely blocking the flow. "Rat-hole" effect is when, due to the different friction forces between, for example, toner particles and other toner particles and toner particles and bin walls, a hole is formed in the toner mass at the bin's exit. This hole is also shaped like a funnel and remains constantly open. Thus, when a batch of new, highly fluidized toner is dumped into the bin, it travels directly through the "rat-hole" since it does not have time to settle. Therefore, when a valve in the bin's hopper is opened, the highly fluidized freshly dumped toner uncontrollably flows through the "rat-hole" flooding the hopper. To prevent bridging and "rat-holing," relatively small hoppers are equipped with a rotating agitator in the form of a mechanical arm. This solution for a bin of 1000 kg would be extremely difficult and would require big energy consuming motor and gearbox. Smaller devices like fluidizers (air injectors) or small agitators positioned near the exit are not always effective or change the density of the material in a harmful way.

Other attempts at improving the flow of controlling the flow of powders include U.S. Pat. No. 5,517,595 issued Apr. 8, 1997 to Jerry R. Johnson et al. employs a cylindrical bin and a conical transition section disposed below the cylindrical bin. In one embodiment, a baffle having triangular cross-sectional areas is disposed within the conical transition section. In another embodiment, the transition section is formed with triangular-shaped, flat side outer panels.

A blending apparatus is disclosed in U.S. Pat. No. 4,286,883 to Johanson includes a conical insert to promote mass flow movement of material in a self-emptying hopper.

Solid particulate material is moved through a hopper bottom bin shown in U.S. Pat. No. 4,548,342 issued Oct. 22, 1985 to Glen W. Fisher in mass flow inducted by a conical surface positioned within the hopper to compensate for the shallowness thereof. Laminar mass flow movement will occur in the uppermost region of the material within the vertical bin walls. The hopper cross-section is separated into segregated flow channels by the conical surface, and by webs extending therefrom. The conical surface and webs have overall dimensions small enough for insertion through a bolt ring on the bottom of the hopper. The proportions of the material flowing through each channel is chosen to achieve a desired discharge flow pattern by varying the relative cross-sectional areas of either the inlets or the outlets of the channels. This results in changes in the velocity profile of the downwardly flowing material in a zone above and adjacent to the separate flow channels.

U.S. Pat. No. 5,769,281 issued Jun. 23, 1998 to Lyndon Bates discloses an insert system for changing the pattern of material flow in a bulk storage hopper during the discharge process, from a form where a channel flow develops within a mass of static material into a form where the entire stored contents are caused to flow. This change is affected by the provision of insert members supported within the hopper, which modify the stress pattern in the flowing contents to allow the bulk material to deform more readily and for slip to take place on all contact surfaces between the material and the hopper walls.

U.S. Pat. Nos. 6,328,183 B1 issued Dec. 11, 2001 to Clarence B. Coleman discloses a bin for storing dry powder bulk material or granules. Bulk material is deposited in an upper section of the bin and is discharged from the bottom of the lower section of the bin. The lower section of the bin is formed with oppositely directed, downwardly sloping walls, joined by opposing vertical walls. The downwardly sloping walls, respectively, slope downwardly at an angle greater than the angle of repose of the material or granules in the bin. Disposed in the lower section of the bin is a planar vertical divider wall that is supported by the vertical walls of the lower section. The vertical divider wall has flat surfaces that face, respectively, the oppositely directed, downwardly sloping walls of the lower section for reducing bridging of the dry powder bulk material or granules in the bulk material bin during mass flow from the upper section through the lower section of the bin.

Thus, the bulk materials handling art has long needed a system that can achieve or exceed the flow control provided by prior art devices, while being easily retrofitted to a variety of existing hopper bottom bins. Especially, if such a device would be inexpensive to manufacture and ship, and would be installed with little or no on-site alteration of preexisting bin structure.

Accordingly, a bin partition that improves flow of powder or particulate material is disclosed that is to be installed into an existing bin. The partition has a triangular-like cross-section with a baffle on top thereof covering a portion of the partition. The partition changes the shape of the exit area of a bin and enables better control of powder or particulate material flow, thus preventing bridging and uncontrolled flooding while filling a bin's hopper.

BRIEF DESCRIPTION OF THE DRAWINGS

The foregoing and other features of the disclosure will be apparent and easily understood from a further reading of the specification, claims and by reference to the accompanying drawings in which like reference numerals refer to like elements and wherein:

Figure 1:
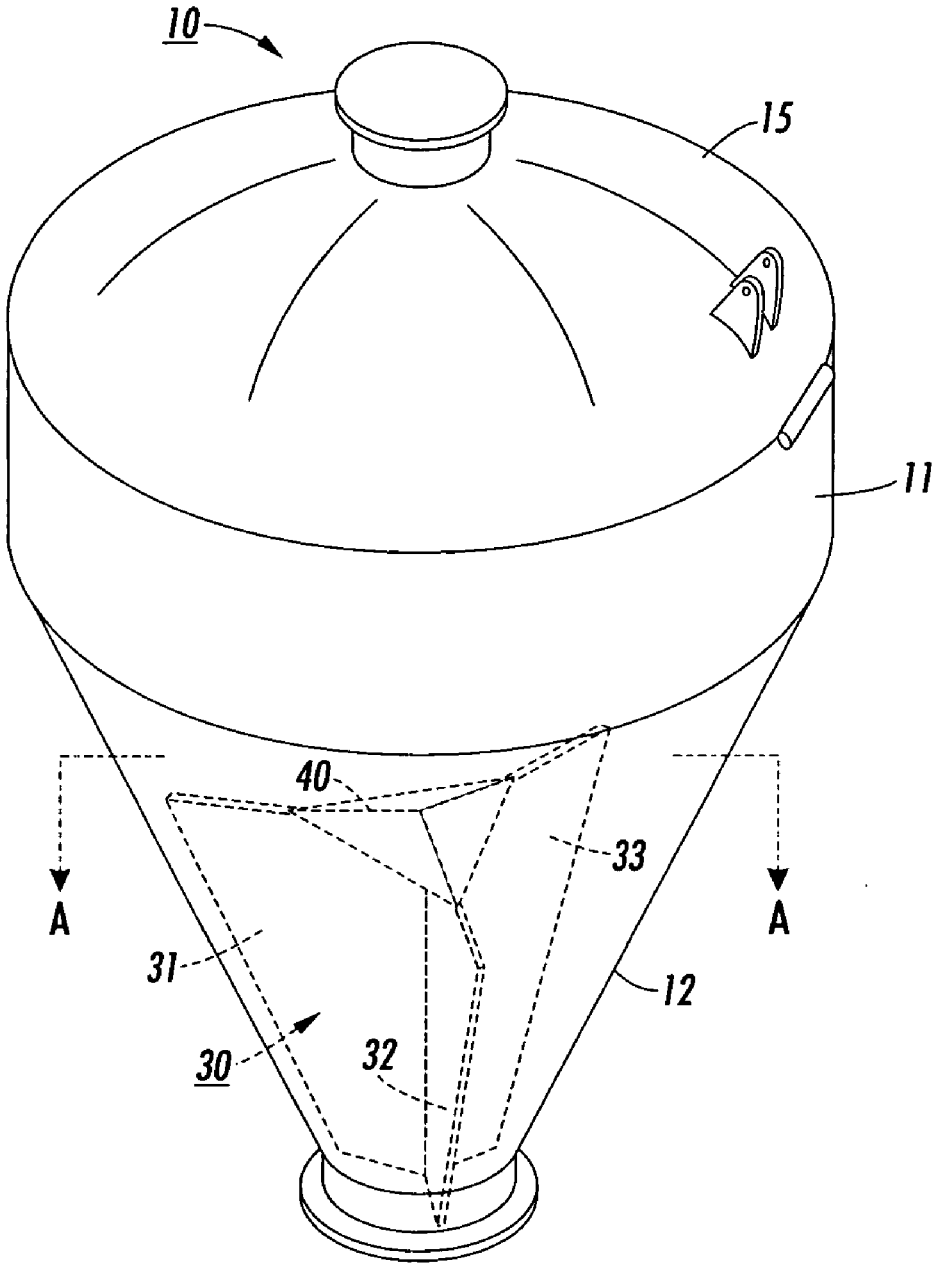
FIG. 1 is an enlarged, schematic isometric view of a typical bin with a partition inserted therein shown in phantom.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the invention as defined by the appended claims.

DETAILED DESCRIPTION OF THE INVENTION

The disclosure will now be described by reference to a preferred embodiment of bin partition and baffle position within a bin. However, it should be understood that the disclosed bin partition and baffle system could be used in any environment in which flow of powder material is a problem. For example, the bin partition and baffle could be used in a toner container used to dispense toner in copiers/printers.

For a general understanding of the features of the disclosure, reference is made to the drawings. In the drawings, like reference numerals have been used throughout to identify identical elements.

FIG. 1 schematically illustrates a bulk material bin or container 10. The bulk material is a dry powder material, for example, toner used in copier/printers. The bin 10 has an upper hollow section or shell 11 and a lower hollow section or hopper 12. The upper section 11 is made of suitable material, such as stainless steel or plastic. The upper section 11 is formed with a circular opening through which the bulk material is deposited. A suitable cylindrically shaped cover 15 is secured to the upper section 11 for opening and closing the circular opening in upper section 11. A partition 30 is inserted within lower section 12 of bin 10 that comprises at least one, but preferably three panels or walls 31, 32 and 33 connected together and projecting outwardly from the center of and resting against the wall of lower section 12 at approximately 120° apart. A baffle 40 includes a plurality of sloping members 41, 42, and 43 that cover a portion of partition 30. Bin partition 30 changes the symmetric, funnel like, hopper exit area of lower section 12 into several asymmetric funnels, thus preventing both bridging and "rat-holing".

Figure 2:
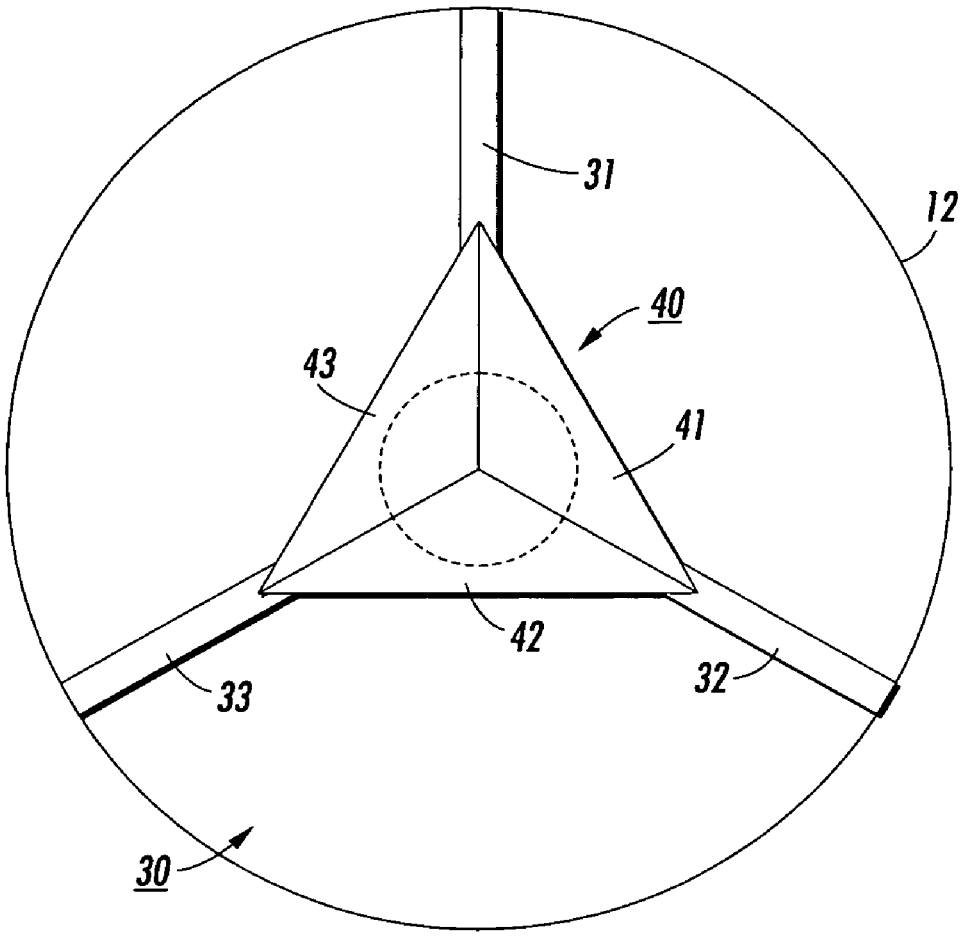
FIG. 2 is a plan view of the bin of FIG. 1 sectioned along dotted line A—A and shows a partition with a baffle member covering a portion of the partition.

As seen in FIGS. 1 and 2, once bin partition 30 has been inserted into the lower section of bin 10, new funnels are created having triangular-like cross-sections and are formed by two walls that are vertical and only one that is part of bin 10. In this manner, bridging is prevented since there are no opposing parallel areas in the new funnels. In addition, the very center of the lower section 12 of bin 10 is now occupied by the partitions joining area (line) of new funnels and a portion of sloped baffle 40 on the top of each funnel to prevent the direct dynamic impact of newly dumped powder and thereby prevent "rat-holing".

It should now be understood that an improvement has been disclosed that improves the flow of powder from a bin through a hopper and includes inserting a bin partition with a baffle above it into the hopper section of a bin in order to change the exit area of the hopper and thereby enable better control of powder flow and prevent bridging and uncontrolled flooding while filling the hopper. The baffle has multiple sloping sections that cover a portion of the partition. The baffle prevents the direct dynamic impact of powder being dumped into the bin.

While specific embodiments have been outlined above, it is evident that many alternatives, modifications and variations will be apparent to those skilled in the art. Accordingly, the preferred embodiments as set forth hereinabove are intended to be illustrative and not limiting. Various changes may be made without departing from the spirit and scope of the invention as defined herein.

What is claimed is:

1. An insert system adapted for positioning within a hopper of a toner container, comprising:

a partition adapted to divide the hopper into at least two funnel areas; and a baffle adapted to deflect powder coming directly out of the toner container, said baffle being positioned perpendicular to and on top of and over the center of said partition in order to cover a portion of said partition to prevent the direct dynamic impact of newly dumped powder and thereby prevent bridging and "rat-holing".

2. The insert system of claim 1, wherein said partition comprises at least one panel.

3. The insert system of claim 1, wherein said partition includes at least three panels.

4. The insert system of claim 3, wherein said panels are triangular-like in cross-section.

5. The insert system of claim 4, wherein said panels are positioned about 120° apart.

6. The insert system of claim 1, wherein said baffle includes a plurality of slopes that reach an apex over the center of said partition and with a portion of said slopes of said baffle positioned on top of each of said at least two funnel areas to prevent bridging of the powder coming directly out of the container.

7. A bulk material bin, comprising:

an upper section for storing bulk material;

a lower section disposed below and in communication with said upper section for receiving bulk material from said upper section for discharging bulk material from said bin, a partition adapted to divide said lower section into at least two funnel areas; and a baffle positioned perpendicular to and on top of said partition and adapted to deflect powder coming directly into said lower section, said baffle being positioned over the center of and cover a portion of said partition.

8. The bin of claim 7, wherein said partition comprises at least one panel.

9. The bin of claim 7, wherein said partition includes at least three panels.

10. The bin of claim 9, wherein said panels are triangular-like in cross-section.

11. The bin of claim 9, wherein said panels are positioned about 120° apart.

12. The bin of claim 7, wherein said baffle includes a plurality of slopes that reach an apex over the center of said partition and with a portion of said slopes of said baffle positioned on top of each of said at least two funnel areas to prevent bridging of the bulk material.

13. A device for controlling the flow of material through a bin having a hopper with an opening at its bottom, comprising:

an insert adapted to be placed into said bin and rest against a wall of said bin and terminate just before said opening at the bottom of said bin, said insert including a partition adapted to divide said hopper into at least two funnel areas; and a baffle positioned perendicular to and on top of said partition and adapted to deflect powder coming directly into said hopper, said baffle being positioned over the center of and cover a portion of said partition.

14. The device of claim 13, wherein said partition comprises at least one panel.

15. The device of claim 13, wherein said partition includes at least three panels.

16. The device of claim 15, wherein said funnel areas are triangular-like in cross-section.

17. The device of claim 15, wherein said panels are positioned about 120° apart.

18. The device of claim 13, wherein said baffle includes a plurality of slopes that reach an apex over the center of said partition and with a portion of said slopes of said baffle positioned on top of each of said at least two funnel areas to prevent bridging of the bulk material.

* * * * *